US005782532A

United States Patent [19]

Opsvik

[11] Patent Number: 5,782,532

[45] Date of Patent: Jul. 21, 1998

[54] ARRANGEMENT IN A CHAIR, ESPECIALLY A CHAIR FOR CHILDREN

[76] Inventor: Peter Opsvik, Pilestredet 27H, N-0164 Oslo, Norway

[21] Appl. No.: 649,667

[22] PCT Filed: Nov. 22, 1994

[86] PCT No.: PCT/NO94/00189

§ 371 Date: May 24, 1996

§ 102(e) Date: May 24, 1996

[87] PCT Pub. No.: WO95/14411

PCT Pub. Date: Jun. 1, 1995

[30] Foreign Application Priority Data

Nov. 25, 1993 [NO] Norway ..... 934275

[51] Int. Cl.[6] ..... A47C 1/02; A47C 7/50

[52] U.S. Cl. ..... 297/338; 297/423.38; 297/451.4

[58] Field of Search ..... 297/337, 338, 297/423.1, 423.11, 423.12, 423.25, 423.19, 451.4, 423.38, DIG. 2, 451.5

[56] References Cited

U.S. PATENT DOCUMENTS

| | | | |
|---|---|---|---|
| 573,133 | 12/1896 | Browne | 297/423.38 X |
| 2,542,480 | 2/1951 | Cramer et al. | 297/423.38 X |
| 3,625,563 | 12/1971 | Dickeinson et al. | 297/423.38 X |
| 4,109,961 | 8/1978 | Opsvik | 297/423.38 X |
| 4,712,835 | 12/1987 | Völkle | 297/304 |
| 4,767,160 | 8/1988 | Mengshoel et al. | 297/423.38 X |
| 4,768,831 | 9/1988 | Liedberg et al. | 297/423.38 X |
| 4,793,655 | 12/1988 | Kralheim | 297/423 |
| 4,832,407 | 5/1989 | Serber | 297/423 |
| 4,960,305 | 10/1990 | Opsvik | 297/423.38 X |
| 5,328,240 | 7/1994 | Neumuller | 297/338 |

FOREIGN PATENT DOCUMENTS

| | | |
|---|---|---|
| 222 675 | 5/1987 | European Pat. Off. . |
| 3 024 920 | 1/1982 | Germany . |
| 3 401 314 | 7/1985 | Germany . |
| 1108117 | 4/1968 | United Kingdom . |

*Primary Examiner*—Milton Nelson, Jr.
*Attorney, Agent, or Firm*—Darby & Darby

[57] ABSTRACT

An arrangement for a chair especially suited for children comprising a back rest and an adjustable chair seat and foot support is disclosed. The chair has a column-like support with a mid-stem comprising a rearwardly extending upper regulating portion and a less rearwardly extending lower regulating portion. The chair seat is attached to the upper regulating portion. Both the height of the seat and its horizontal position relative to the back rest are regulated by adjusting the position of the chair seat along the upper regulating portion. The foot rest is attached to the lower regulating portion. The vertical and horizontal distance between the foot rest and the chair seat is regulated by adjusting the position of the foot rest along the lower regulating portion. The position of the chair seat and foot support can easily be adjusted by hand to configure the chair for a wide variety of differently sized individuals.

29 Claims, 11 Drawing Sheets

ARRANGEMENT IN A CHAIR, ESPECIALLY A CHAIR FOR CHILDREN

FIELD OF THE INVENTION

The present invention relates to an arrangement in a chair, especially a chair for children, comprising a back rest, a chair seat and a foot support, said chair seat and foot support being attachable at adjustable levels above the foundation of the chair.

PRIOR ART

From NO 132.782 (Peter Opsvik) there is known a chair having two side members which at the bottom merge into a leg support and at the top carry a back rest connecting the upper portions of the side members, said side members at their inner surfaces being provided with tracks, wherein can be inserted the side edges of a seat plate and a foot plate, respectively, which plates thereby are given an optional height as well as an optional horizontal position in relation to said side members.

Such a chair can, due to its adjustability, be adapted to both small children, larger children and even to adult persons, i.e. cover a sitting requirement throughout the overall adolescence of a person.

In order to adjust the seat plate and the foot plate, however, there is a need for using both hands, at the same time as the plates cannot be pulled out from the side members and be inserted into a new position before specific attachment or locking means between the side members have been released, especially by means of tools.

From NO 126.294 (Peter Opsvik) there is further known an arrangement in a chair of the type comprising a seat plate and a back plate which optionally in a height adjustable manner can be attached to supporting pillars extending from a leg base, said back plate and seat plate being displaceable along portions forming an obtuse angle in relation to each other. However, the cusp of the angle faces forwardly of the chair, and the supporting pillars comprise parallelly running pipe posts to which the back plate and seat plate, respectively, are attached at their side edges. It is true that an alteration of the seat depth can be achieved in relation to the back rest, but that requires a mutual regulation of the back rest and the seat plate, at the same time as the adjustment requires the use of both hands and comprises the loosening of fastening bolts at respective side portions of the seat plate and back plate. Besides, this prior art chair comprises no foot support which can be regulated in relation to the seat plate, which involves that the user of the chair must obtain support for his feet at floor level, which for small persons entails that they can not reach to normal table height.

From NO 150.743 (Eknes) there is known an adjustable chair, especially a chair for children, comprising a chair seat and a foot support which can be adjusted along a chair member extending upwardly and rearwardly in a slanting manner, through a supporting sleeve with associated stopper means, said chair seat and foot support being kept in place in selected position due to the stopper means under the influence of the weight of the chair seat and foot rest, respectively, as well as the load being imposed thereupon.

However, the chair member extending upwardly and rearwardly in a slanting manner is contemplated to be implemented only as two pipe-shaped front chair legs which together with the rear leg pairs of the chair constitute four legs requiring unnecessary space in relation to the foundation of the chair. Further, there are provided supporting sleeves and stopper means for the chair seat and foot rest, respectively, on each of the front legs, which during the adjustment operation will be subjected to wedging during upwardly or downwardly regulation. Such a chair also requires free access from the front in order to allow a child or an underaged to reach the seat via the foot support, which in turn requires that the chair must be pulled completely back from the table in order to give a step function. If the underaged should try to climb the chair from the side, via the foot support, this would be very difficult, at the same time as there exists a danger of tilting the chair. Besides, the foot support is very small in relation to the seat surface itself, which entails a reduced possibility not only for the climbing of the chair, but also for the support of the legs in various sitting positions. Finally, the regulation of the chair seat and the foot support requires a lifting of same.

DE 3 401 314 relates to a chair having a supporting element providing two sections which are "bent" in opposite direction, there being on different sections provided displaceably mounted back rest and seat plate, respectively. This is different from a chair wherein the two sections are bent in "same direction", at the same time as the different sections support a seat portion and a foot portion, respectively, and at the same time as the back rest is substantially permanently mounted. Further, the prior art chair is made for adaption to different table heights, but without providing any foot support on which the user can rest his leg.

U.S. Pat. No. 4,712,835 relates to a chair, especially for children and teenagers, comprising a central supporting frame carrying a back rest and a seat portion, at individual frame portions which are bent in opposite direction, but neither here has anybody contemplated any foot support as the case is in the chair for children according to the present invention.

GB 1 108 117 relates to an office chair, especially a chair for typists, comprising a central stem onto which a back rest and a seat portion can be displaceably attached, but neither here is there any token about a foot support, let alone any provision of a central stem providing the functional advantages between a seat portion and a foot support, which the present invention prescribes.

DISCUSSION OF THE INVENTION

The object of the present invention is to provide an arrangement in a chair, especially a chair for children, which can more easily be adjusted without tools, especially adjustment by means of only one hand, and which can be adjusted even when the child is sitting on the chair seat.

In addition to a simpler adjustment the present invention also provide a chair for children which can be regulated in a more simpler manner, especially for the chair seat in relation to the back rest independent of the size of the user, the effective seat depth being automatically regulated when the height level of the seat is adjusted to the size of the user.

Further, an objective of the invention is to provide a chair wherein the climbing of the chair from the side, especially the climbing up of children, can be exercised more easily then compared with previously known chairs for children, especially when the chair is positioned close to a table.

Further, an objective of the present invention is to provide a chair for children which is space saving and easier to position, for example at or close to a table, at the same time as the structure is composed of relatively simple element.

These and other objects are achieved according to the present invention in a chair of the type as stated in the preamble, which is characterized in that the chair seat and the foot support are adjustable in relation to a centrally provided column-like supporting means, especially a central stem, the projection plane of which substantially coinciding with the central plane of the chair, comprising portions allowing regulation of the chair seat in an angle comprising 10°–55° and regulation of the foot support in an angle comprising 65°–90°.

Consequently, an embodiment of the invention can be such that the centrally arranged column-like supporting means comprises a dominating central stem, possibly having branches in the central projection plane of the central stem.

The upper portion has a slanting angle which makes it possible for the depth of the seat to become automatically correct when the seat is adjusted to such a position that the elbow of the user is at level with the table plate.

Further, the portion of the central stem along which the foot support can be displaced, is adapted in such a manner that it follows the size of the person who is to use the chair.

It is to be understood that the discussed angles in practice can be mutually substantially constant, but possibly comprise individual or mutual variations depending on the level.

More specifically, an embodiment can be to the fact that the central stem is provided with a lower, rearwardly tilting portion substantially in the area of a foot support, that the lower, rearwardly slanting portion of the central stem merges into a further rearwardly slanting portion, especially in the area of the chair seat, whereafter the further rearwardly slanting portion merges into an oppositely curved portion joining a more or less slanting straight portion in the area of the back rest. When the chair seat is in its upper position the seat surface will be shortened in relation to the back rest, especially for small children.

If the chair seat at its rear edge is provided with a first recess, the chair seat will in its upper positions, i.e. closer to the back rest, also have its effective seat surface shortened, which is especially favourable for small children. Said recess in the rear edge of the chair seat can appropriately render a shortened seat surface when the seat has been pushed completely back. Depending on the size of the recess and the shape of the central. stem there can be achieved favourable possibilities for regulation of the chair seat, and then without individual portions of the chair seat or the mid-stem protruding unnecessarily far behind in rearward direction in relation to the plane of the back rest.

By providing the foot support at its rear edge with a second recess which more or less embraces a lower portion of the central stem, there are provided rearwardly extending side portions which can protrude beyond the rear of the central stem for thereby constituting steps for stepping on to the chair both from the front and from the side and even from the rear, and/or providing support for rearwardly displaced legs in sitting position.

In order to achieve such an improved staircase step effect, especially when climbing into and climbing out for an underaged, especially when the chair is positioned close to a table, it is appropriate that the foot support has a larger dimension, especially a larger width and/or depth than the chair seat, which solution is especially favourable in connection with the discussed central midstem. A larger foot plate is important in order to provide different sitting positions for the user and to avoid fixed feet positions, static sitting positions easily paving the way for stress damages.

In order to avoid that the chair seat or the foot support should be displaced after the attachment and during use it is appropriate that the central stem is provided with one or more conical portions rendering safety against sliding of attached foot support and chair seat.

Appropriately, a feature of the chair is to the fact that in the area of the slanted portions of the central stem there are provided attachment means for the chair seat and the foot support, respectively, which can be operated from the rear side of the chair.

It is to be understood that the central stem can be designed in a plurality of various manners, for example as a continuous piece, or composed of two or more sections.

An embodiment of the invention can in this connection be a substantially continuous central stem comprising an upper portion which constitutes an approximately straight or substantially obtuse angle in relation to the regulating angle of the chair seat, especially in the area of the back rest, the cusp of the angle facing in rearward direction from the chair.

If there is chosen an embodiment of the central stem comprising two or more composed sections, the portion of the central stem constituting the regulating portion of the chair seat could be a portion which extends freely from said central stem.

Especially in view of single hand regulation the central stem may be provided with a lower regulating track along which the foot support can be regulated, and with an upper regulating track along which the chair seat can be regulated.

However, the central stem may comprise two substantially similar stem pieces having a gap therebetween along which the attachment means for the chair seat and foot rest, respectively, can be displaced for appropriate adjustment of same.

Said central mid-stem can appropriately be supported at the bottom by a substantially diagonal leg cross, rings, plate or similar, and such bases can favourably be provided with caster wheels, at the same time as the lower portion of the central stem can be constituted by for example a substantially vertical cylinder.

A base in casted material is also contemplated, possibly carrying a mounted, casted or co-casted central stem.

Said attachment means for chair seat and foot support, respectively, may appropriately be adapted for single hand operation.

Finally, the upper portion of the central stem may comprise an exchangeable/mountable guarding means, especially for smaller children, possibly in combination with an exchangeable/mountable back rest.

Further advantages and features of the present invention will appear from the following description taken in connection with the appended drawings, as well as from the enclosed patent claims.

BRIEF DISCLOSURE OF THE DRAWINGS

DETAILED DESCRIPTION OF EMBODIMENTS

Figure 2:
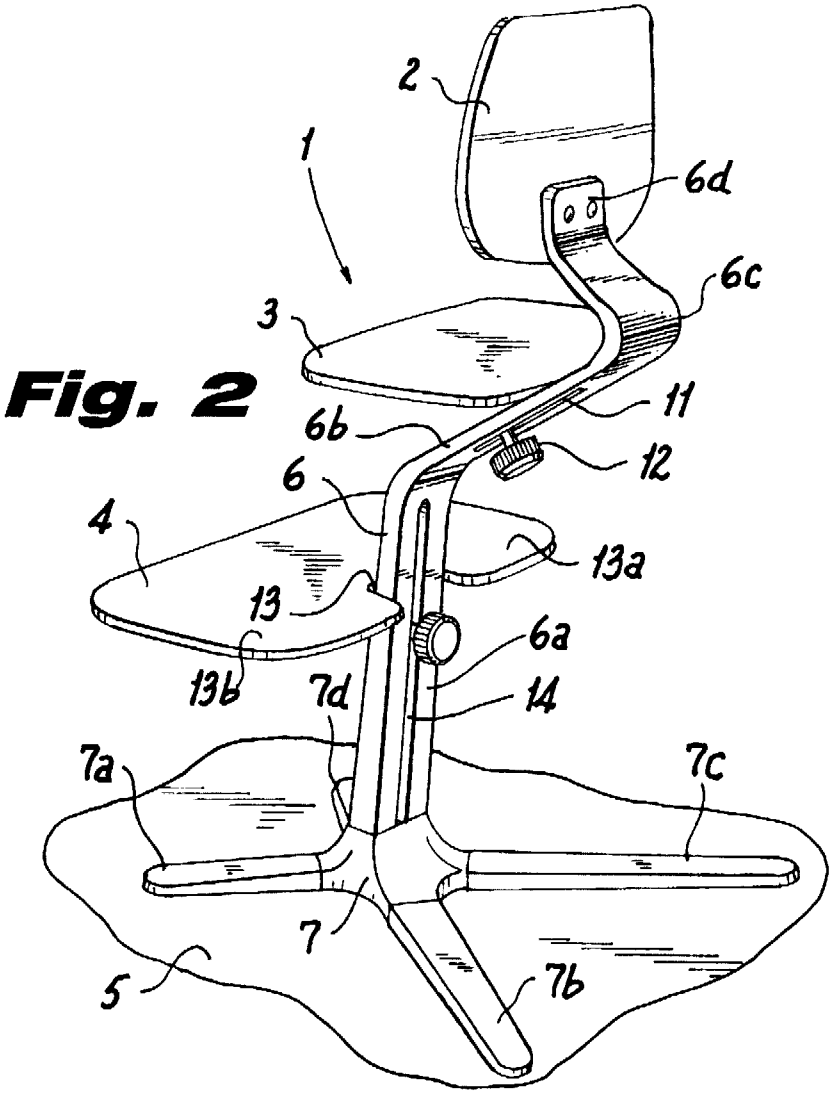
FIG. 2 is a perspective slanted rear view of the chair illustrated in FIG. 1.
Figure 1:
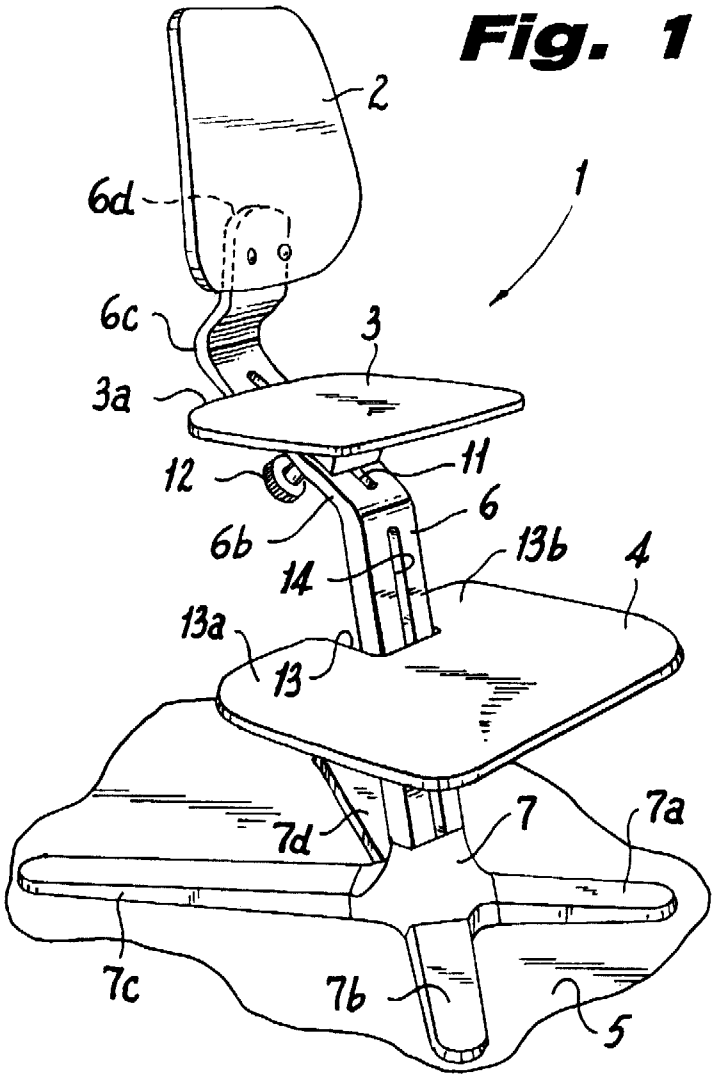
FIG. 1 is a perspective front view of a first embodiment of hair according to the present invention.

In FIGS. 1 and 2 which perspectively illustrate a first embodiment of a chair according to the present invention, especially a chair for children, including possibilities for regulation adapted to the size of a human body, the chair itself is designated by reference numeral 1. The chair 1 comprises a back rest 2 which preferably can be permanently mounted, but which also can possibly comprise attachment means for a baby's guard, a chair seat 3 and a foot support 4, said chair seat 3 and foot support 4 being adapted to be attached at adjustable levels above the foundation 5 of the chair.

What primarily is specific in the chair illustrated in FIGS. 1 and 2, is that it comprises a centrally arranged post-like supporting means, the projection of which coincides with the central plane of the chair, here preferably designed as one single mid-stem 6 which in its specific design renders both reduced space requirement and simpler regulation, especially from the rear of the chair, as well as further comfortable possibilities of application, especially a more easy climbing up and climbing down near a table. Basically, the single mid-stem 6 is designed more or less with inclined portions in relation to the foundation 5, said portions providing for regulation of the chair seat 3 in an angle comprising 10°–55° and regulation of the foot support 4 in an angle comprising 65°–90°.

In the specific non-limiting embodiment which is illustrated in FIGS. 1 and 2, the mid-stem 6 itself is at its bottom attached in a leg cross 7 comprising for example four legs, 7*a*, 7*b*, 7*c* and 7*d*, respectively, and comprising a lower rearwardly slanting portion 6*a*, substantially in the area of said foot support 7, said lower rearwardly slanting portion 6*a* of the mid-stem 6 merging into a further rearwardly slanting portion 6*b*, especially in the area of the chair seat 3, whereafter the further rearwardly slanting portion 6*b* merges into an oppositely curved or double-curved portion 6*c* joining a more or less slanting or straight portion 6*d* in the area of the back rest 2.

It is to be understood that the upper rearwardly slanting portion 6*b* has an angle which is adapted to the distance above the floor 5, such that the seat height in relation to the back rest 2 renders an appropriate seat depth i.e. the chair height and the depth of the seat follow the size of the person sitting on the chair. Further, the angle of the lower rearwardly slanting portion 6*a* along which the foot support 4 is regulated, is such adapted that also the depth displacement will be adapted to the size of the body of the user of the chair. Consequently, by downward regulation the seat depth of the seat chair 3 will increase, at the same time as the foot plate 4 by downward regulation grows outwardly from the back rest 2 together with growing seat depth.

It is to be understood that the chair seat 3 at its rear edge 3*a* can be provided with a first recess allowing for the chair seat 3 in upper positions, i.e. closer to the back rest 2, to have its effective seat surface further shortened in relation to said back rest 2. This is further illustrated in FIGS. 4A and 5.

Figure 3:
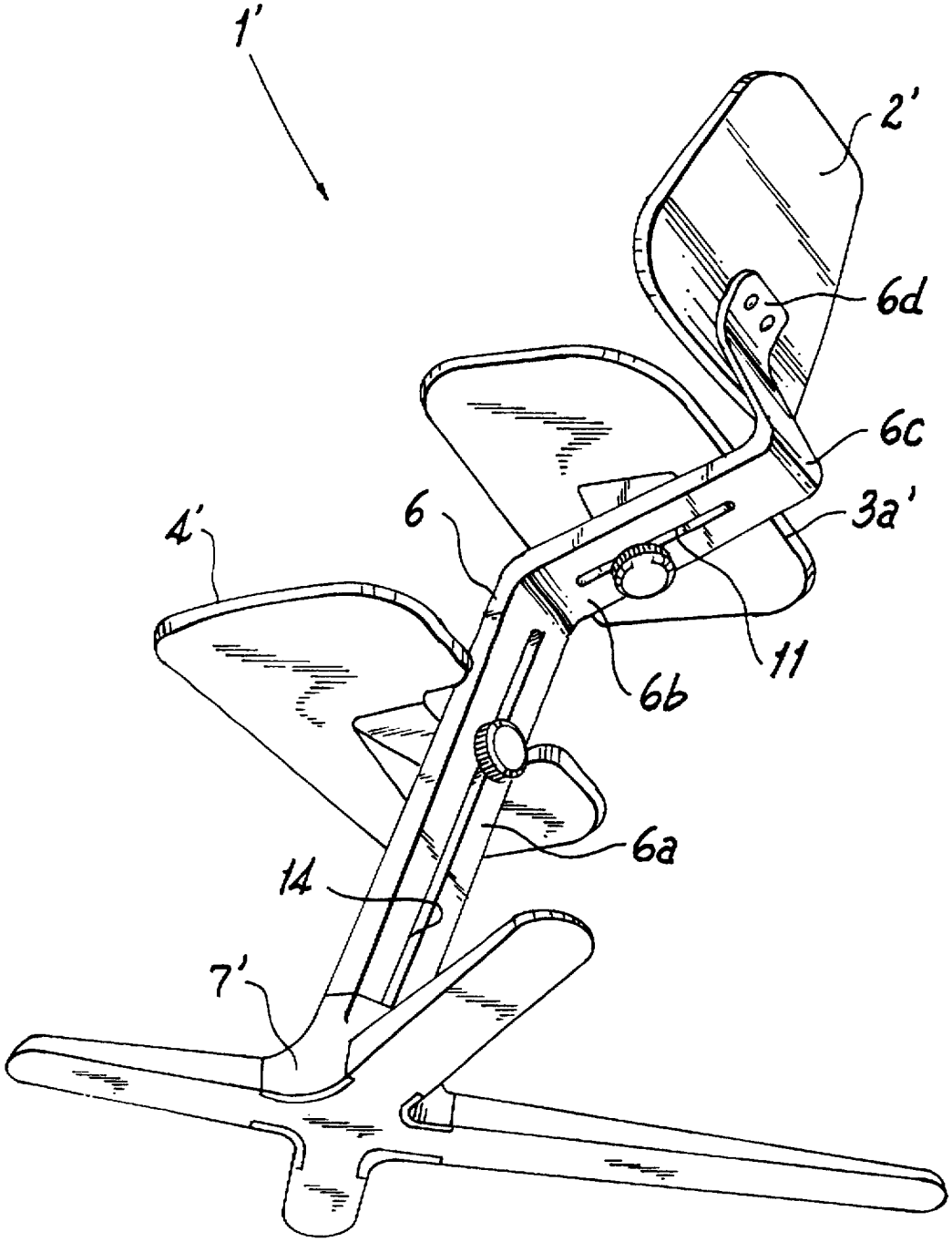
FIG. 3 is a perspective slanted rear view of a variant of the chair according to the invention, illustrated with a second adjustment of the chair seat.

In FIG. 3 which illustrates a variant 1' of the chairs illustrated in FIGS. 1 and 2, the chair 3' is shown in a position which is closer to the back rest 2' then what is depicted in FIGS. 1 and 2, which involves that the rear edge 3*a*' is displaced into the area of the double-curved portion 3*c* of the mid-stem 6, which provides for a shortened seat surface in relation to the back rest 2'.

As appearing from FIG. 3A, the chair 3" will here be in its upper position, which means that said recess 8 completely surrounds the double-curved portion 6*c*, in such a manner that the rest of the seat protrudes outwardly a shorter distance A from the upper portion of the mid-column 6, or more specifically from the supporting surface of the back rest 2', for thereby providing a shortened seat surface for a little child 9 sitting on the chair seat 3".

Figure 5:
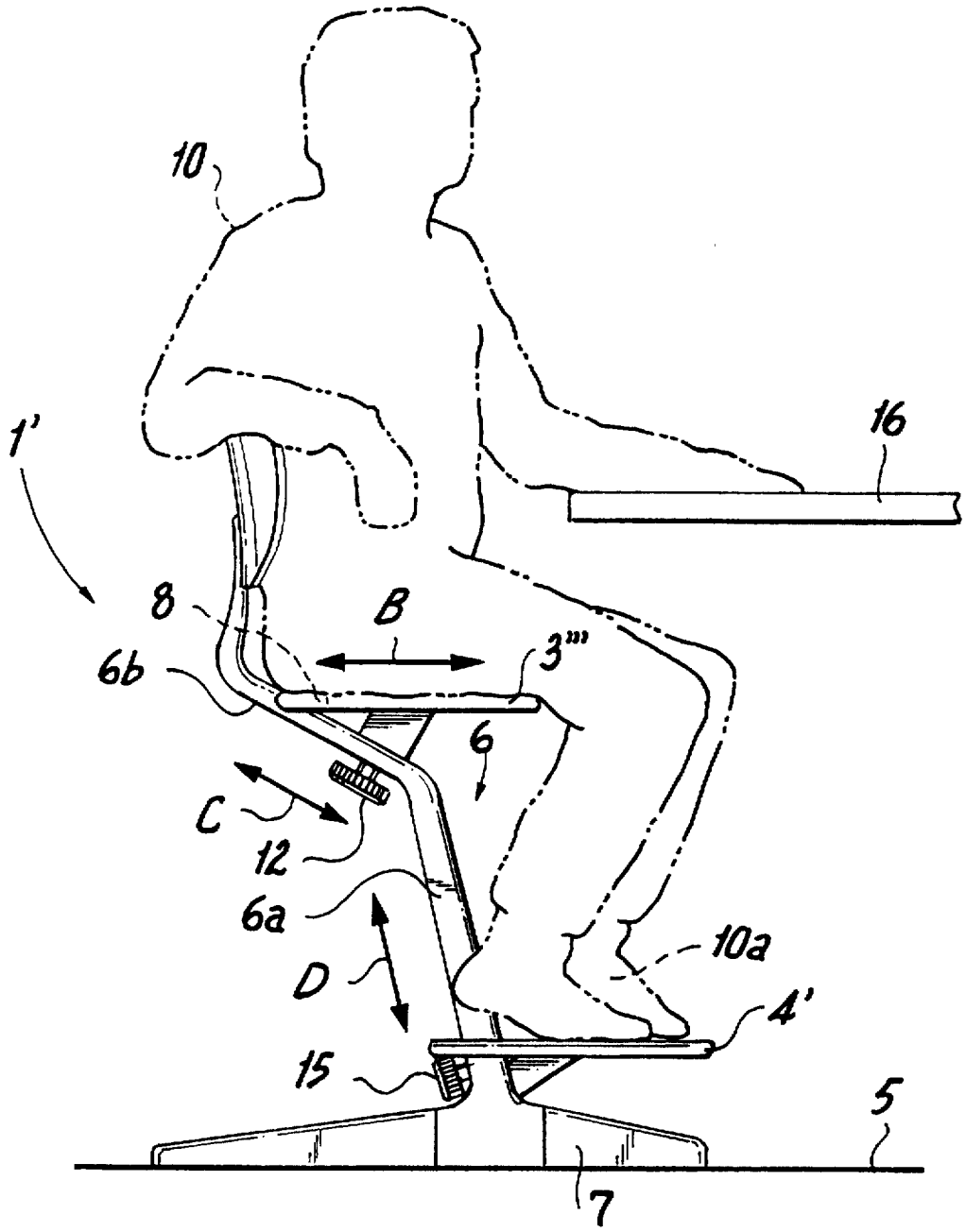
FIG. 5 is a side view illustrating the chair according to the invention used by a larger person or an adult.

As appearing from FIG. 5 the chair seat 3'" is lowered to its lowermost position for thereby providing a larger seat area, here illustrated by the double arrow B, for a larger person 10 sitting on the chair seat 3'".

Figure 4A:
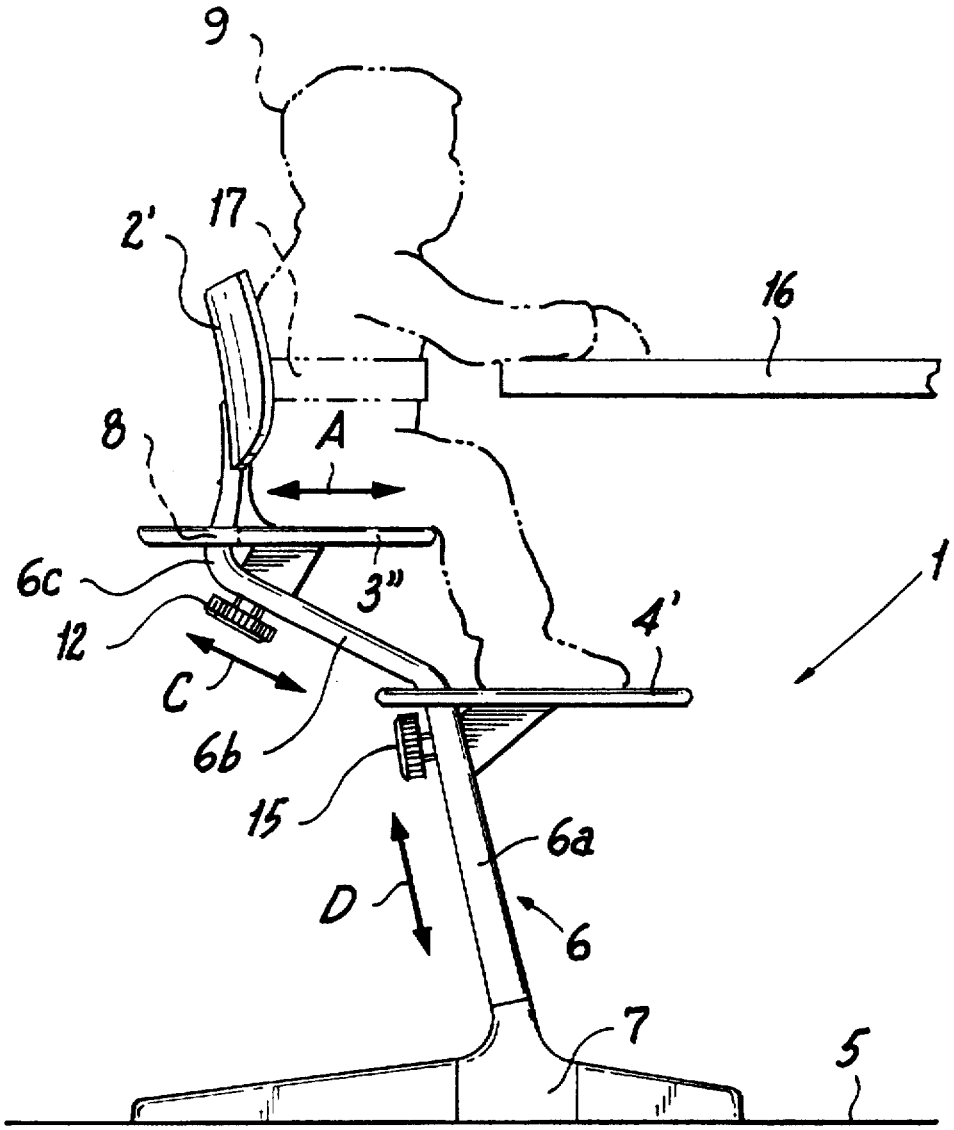
FIG. 4 is a schematic side view of the chair illustrated in FIG. 3 used by a small child.
FIGS. 4B–4E illustrate schematically how an underage person a simple and tilt-safe manner can utilize the stair se function of the chair illustrated in FIG. 4A.

It is to be understood that the chair seat 3 can be regulated between the positions illustrated in FIGS. 4A and 5, especially along an upper regulating track 11, see FIGS. 1 and 2 which is provided in the further rearwardly slanting portion 6b of the mid-stem 6, said seat 3 being adjustably attached in said regulating track 11 by means of appropriate detachable attachment means 12. Said attachment means 12 can appropriately be provided with a wheel, for thereby providing a simple single hand adjustment of the chair seat 3 to the various desired positions, i.e. in this embodiment, along the regulating track 11 and across the area C which is illustrated by the double arrows having this designation in FIGS. 4A and 5.

Also the foot support 4 can at its rear edge 4a be provided with a recess 13 which more or less embraces the lower portion 6*a* of the mid-stem 6, such that there are formed rearwardly extending side portions 13*a*, 13*b* which can extend rearwardly beyond said mid-stem 6, for thereby constituting staircase steps by stepping on the chair 1, and/or support rearwardly positioned legs, see specifically FIG. 5, wherein the person 10 sitting on the chair will have support for his foot 10*a* also in the area behind the mid-stem 6.

The foot support 4 can be regulated along a lower regulating track 14 provided in the lower portion 6*a* of the mid-stem 6, and the area of regulation appears by the double arrows designated D in FIGS. 4A and 5.

Also the foot support 4 can be regulated by means of detachable attachment means 15, see FIG. 2, preferably provided with a wheel for simple single hand operation similarly to the chair seat 3.

As appearing from FIGS. 1 and 2 the foot support 4 can favourably have a larger dimension, especially a larger width and/or depth than the chair seat 3, which renders an improved staircase step function, especially for sideways stepping into the chair, especially for smaller children.

This stair casestep function is specifically pronounced in connection with the central mid-stem 6 which constitutes no obstacle for side-ways entering of the chair via the foot support. In FIG. 4B–4E there are further illustrated the advantages of this stair casestep function.

Figure 4C:
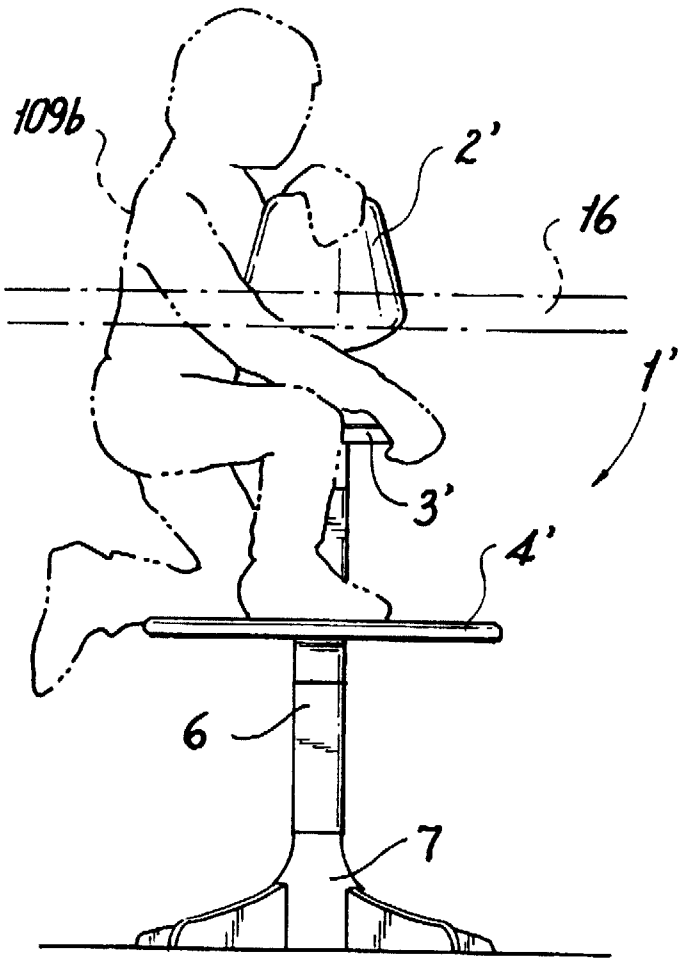
Figure 4B:
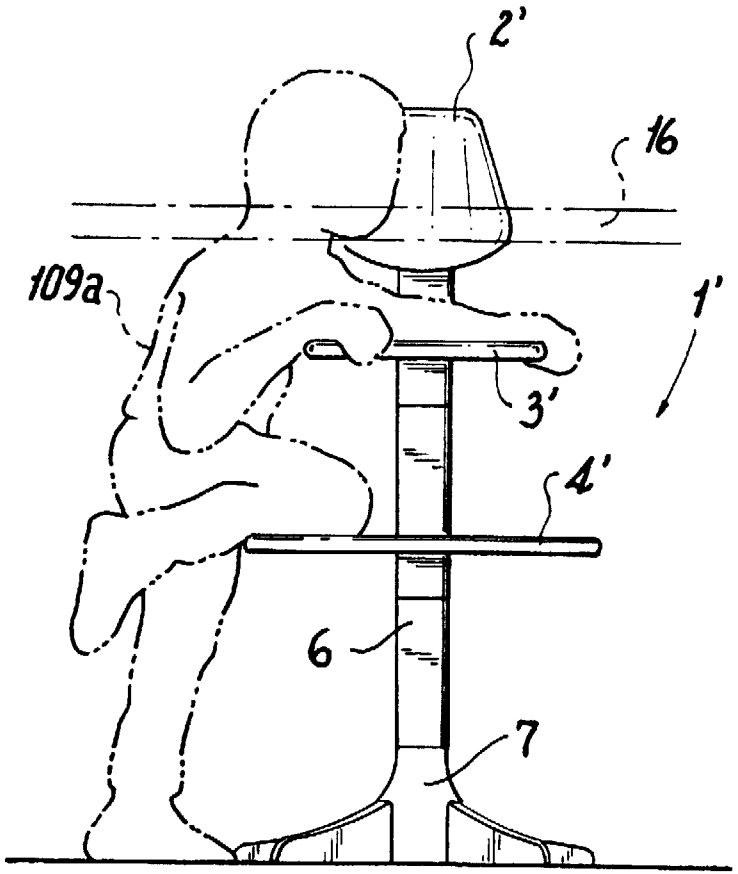
Figure 4E:
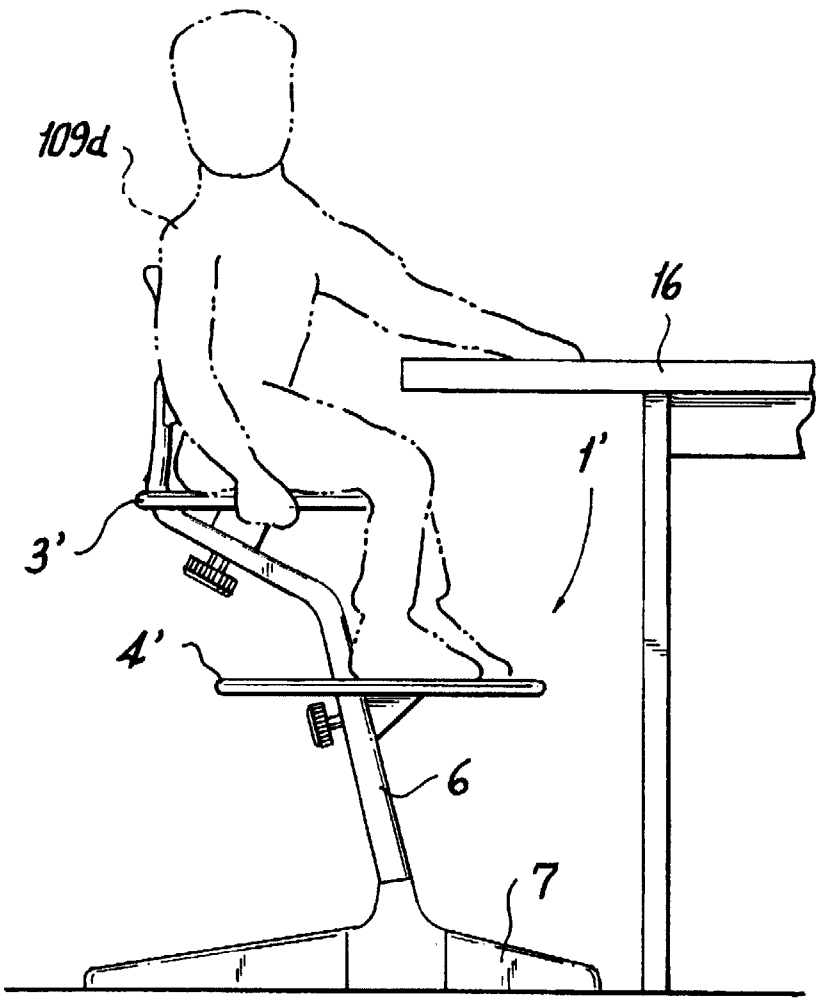

FIG. 4B illustrating a person 109*a* entering the chair 1' from the side, one of the knees being positioned on the foot support 4'. The chair 1' can for example be positioned close to a table 16, but due to the staircase step function it is not necessary to move the chair 1' back from the table in order to give the person 109*a* access to the chair itself in that manner which is illustrated in FIG. 4B.

Figure 4D:
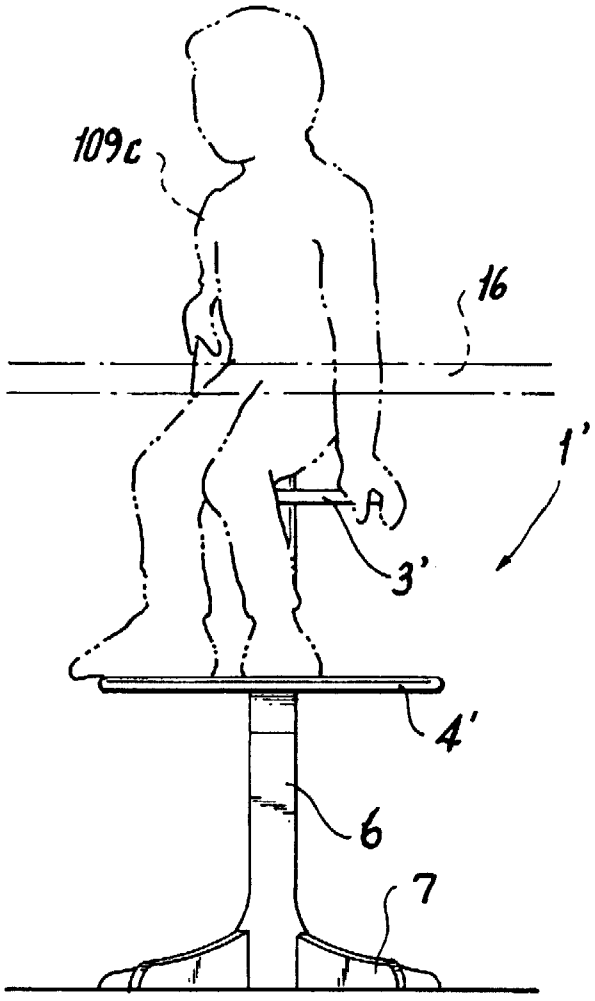

In FIG. 4C the person 109*b* has placed his one knee and his one foot on the foot support 4', at the same time as he is gripping around the chair seat 3' and back rest 2' with his arms. Even in this climbing situation there will in the chair 1' be no danger of tilting because the point of gravity of the person 109*b* will be safely within the bottom leg cross 7. In FIG. 4D the person 109*c* has taken an initial sitting position having his legs positioned on the foot support 4', i.e. immediately prior to the sitting position taken by the person 109*d* according to FIG. 4E, or by the person 9 in FIG. 4A.

Because the foot support has been made broader and deeper than the chair seat a vertical ladder will be avoided and staircase steps will be provided to be used even if the chair is positioned close to a table. Additionally, the rearwardly displaced foot support will give extra support for rearwardly extending legs in sitting position, see specifically FIG. 4A and 5.

As appearing from FIG. 4A there is here disclosed a guarding means 17 serving to support the person 9 sitting on the chair 1', especially as regards smaller children. It is to be understood that such a guarding means can be replaceable/mountable especially for smaller children.

Appropriately, the mid-stem 6 can have a tapered design for security against sliding of clamped foot support 4 and chair seat 3 upon loading, i.e. when said attachment means 12 and 15 have been clamped at their respective selected levels for chair seat 3 and foot support 4, respectively. Conical design of the mid-stem 6 entails that even if the respective attachment means 12 or 15 should become loose or be not sufficiently clamped during use, they will only be displaced downwardly a little distance before they will be catched by wedging. Such a wedging will also contribute to the binding and stableising of the structure.

Figure 6:
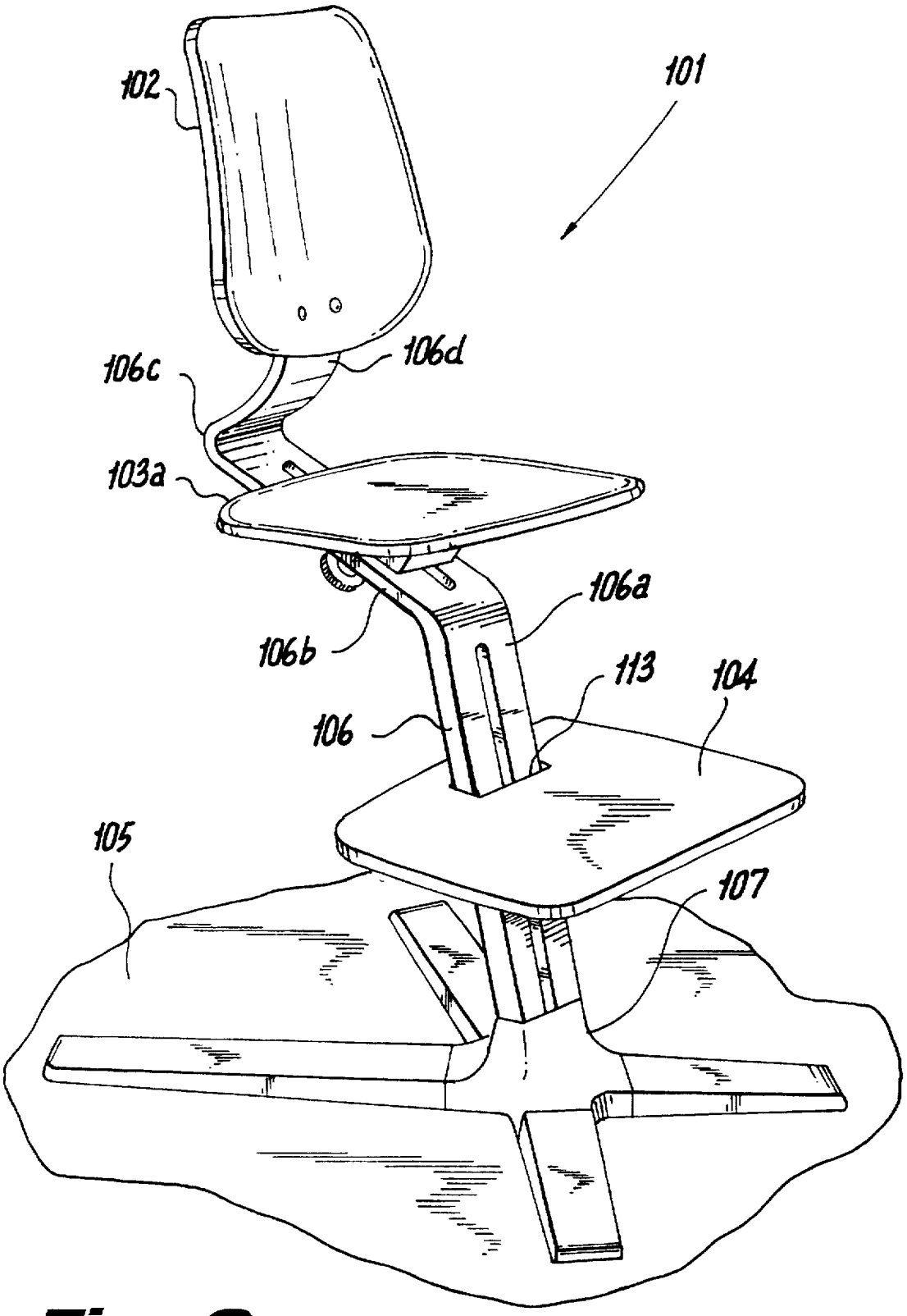
FIG. 6 is a schematical slanted front view of a further variant of the chair according to the present invention.

In FIG. 6 there is illustrated a further variant of a chair according to the invention, wherein the chair 101 itself also here comprises a back rest 102, a chair seat 103 and a foot support 104, provided on a single mid-stem 106 which at the bottom is attached to a leg cross 107 resting on a foundation 105. Also here the mid-stem 106 comprises a lower rearwardly slanting portion 106a along which the foot support 104 can be regulated, a further rearwardly slanting portion 106*b*, especially in the area of the chair seat 103, which further rearwardly slanting portion 106*b* merges into an oppositely curved or double-curved portion 106*c*, which in relation to the double-curved portion 6*c* illustrated in FIG. 1, can be further salient before it merges to a more or less slanting top portion 106*d* in the area of the back rest 102.

The further salient double-curved portion 106*c* is so arranged that it allows the rear edge 103*a* of the chair seat 103 to be pushed close underneath the back rest 102 and rearwardly beyond the main plane of said back rest 102 when the chair seat 103 is in its highest position, similar to what is illustrated in the previously discussed FIG. 4A.

By means of the salient double-curved portion 106*c* in the area of the chair seat 103 there is without any rear recess in the chair seat 103 achieved a degree of regulation of the same order as discussed in connection with the embodiment according to FIGS. 4A and 5, wherein the chair seat is provided with a rear recess which specifically became functional at the highest setting of the chair seat.

It is to be understood that a more or less deep as well as degree of double-curving can be combined with a view of optimal dimensioning of protruding portions in relation to the mid-stem and/or back rest.

Further, in FIG. 6 it is illustrated that the foot support 104 is provided with a recess 113 which here can embrace the portion 106a of the mid-stem.

Figure 8:
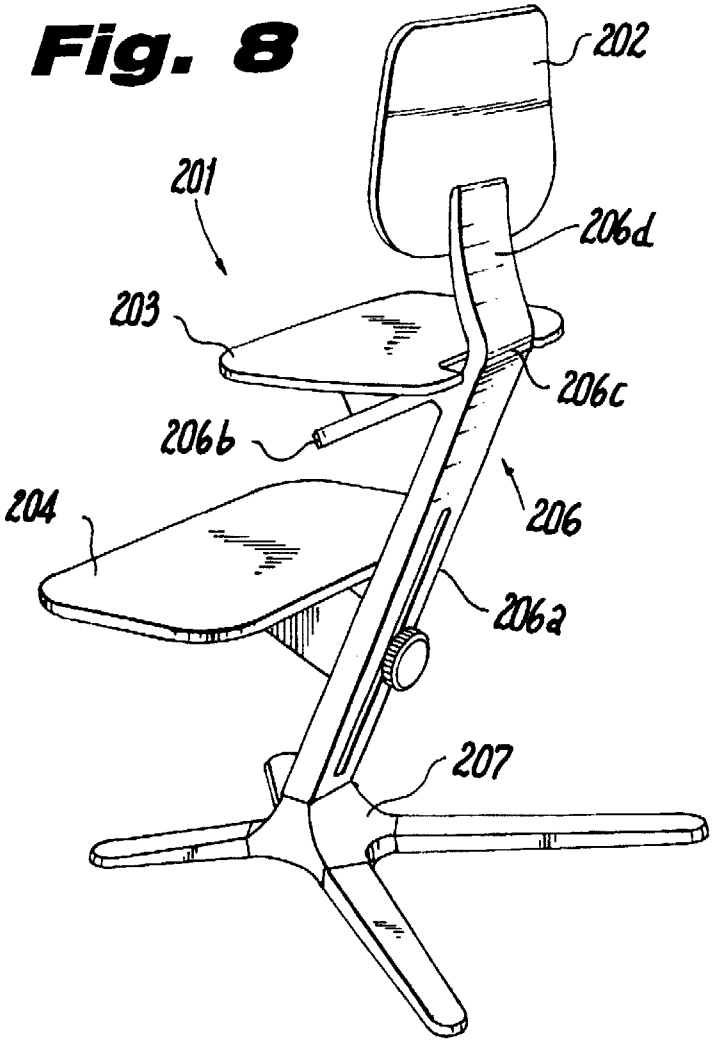
FIG. 8 is a perspective view of the chair illustrated in FIG. 7 as seen obliquely from the rear.
Figure 7:
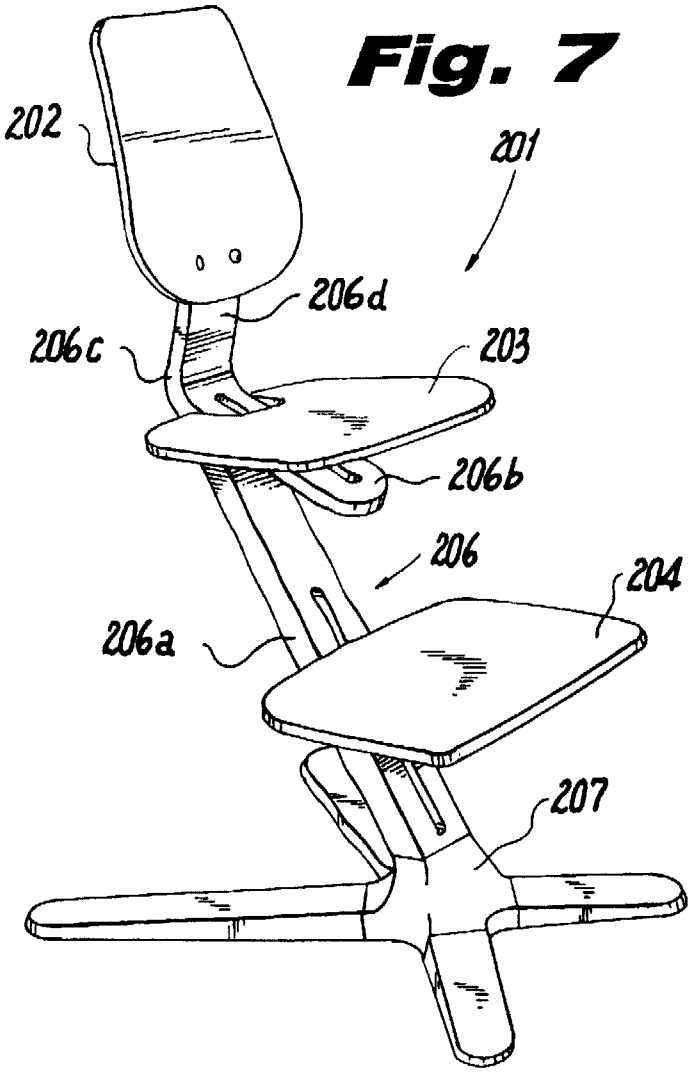
FIG. 7 is a schematic slanted front view of still another variant of the chair according to the present invention.

In FIGS. 7 and 8 there are illustrated perspective views seen from the front and from the rear, respectively, of a further embodiment of a chair 201 according to the invention, wherein the mid-stem 206 carried by a base 207 can be said only to a certain degree to comprise a continuous member, namely substantially the portion 206*a* rendering the regulating angle for the foot support 206 and the upper portion 206*d* carrying the back rest 202, the portion of the mid-stem constituting the regulation portion 206*b* of the chair seat 203 being provided as a portion which extends freely from said mid-stem 206.

The freely extending portion 206*b* is at the top attached to the mid-stem 206 at a more or less curved portion 206*c*.

It is to be understood that the mid-stem can comprise one or more protruding portions, for example an upper protruding portion which carries the chair seat, and/or a lower protruding portion which possibly constitutes an additional support in the central plane of the chair.

Further, it is to be understood that the mid-stem with its two regulating portions can have a substantially opposite V-shape or U-shape.

Figure 10:
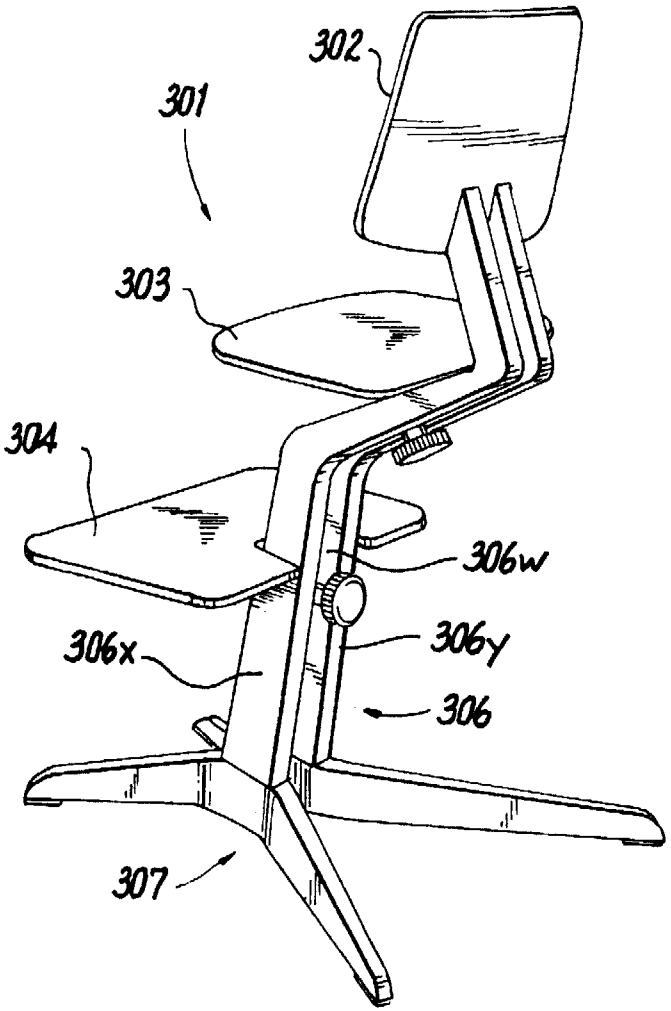
FIG. 10 is a perspective view of the chair illustrated in FIG. 9 as seen obliquely from the rear.
Figure 9:
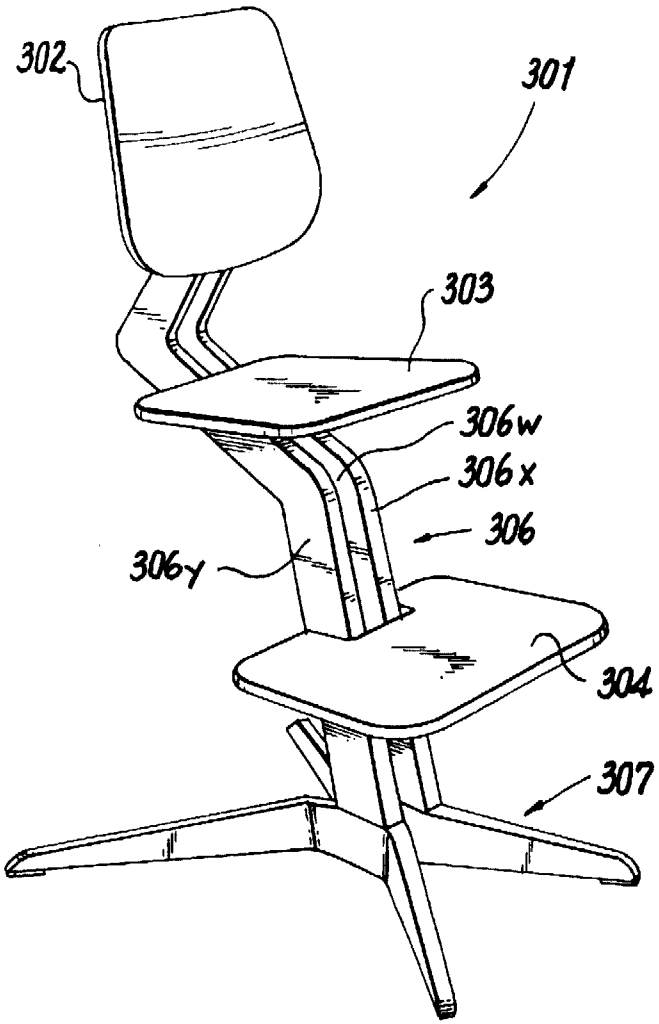
FIG. 9 is a slanted perspective front view of a further variant of a chair according to the present invention.

In FIGS. 9 and 10 there are illustrated perspective views as seen from the front and from the rear, respectively, of still another embodiment of a chair 301 according to the invention, the mid-stem 306 comprising two substantially similar stem members 306*x* and 306*y* having a gap 306*w* therebetween, along which not illustrated attachment means for a chair seat 303 and foot support 304, respectively, can be displaced in accordance with previously discussed principles, at the same time as the mid-stem 306 rests upon a specific leg across 307 which also here renders favourable access possibilities around the chair, specifically for side entrance.

Figure 12:
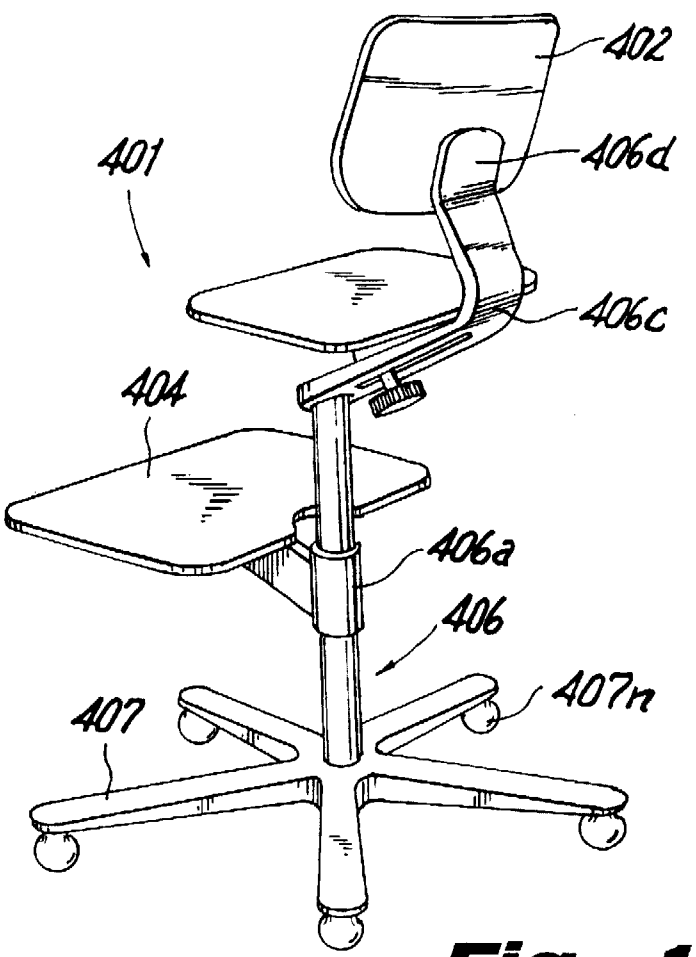
FIGS. 11 and 12 are perspective views seen from the front and from the rear, respectively, of a further embodiment of a chair according to the invention.
Figure 11:
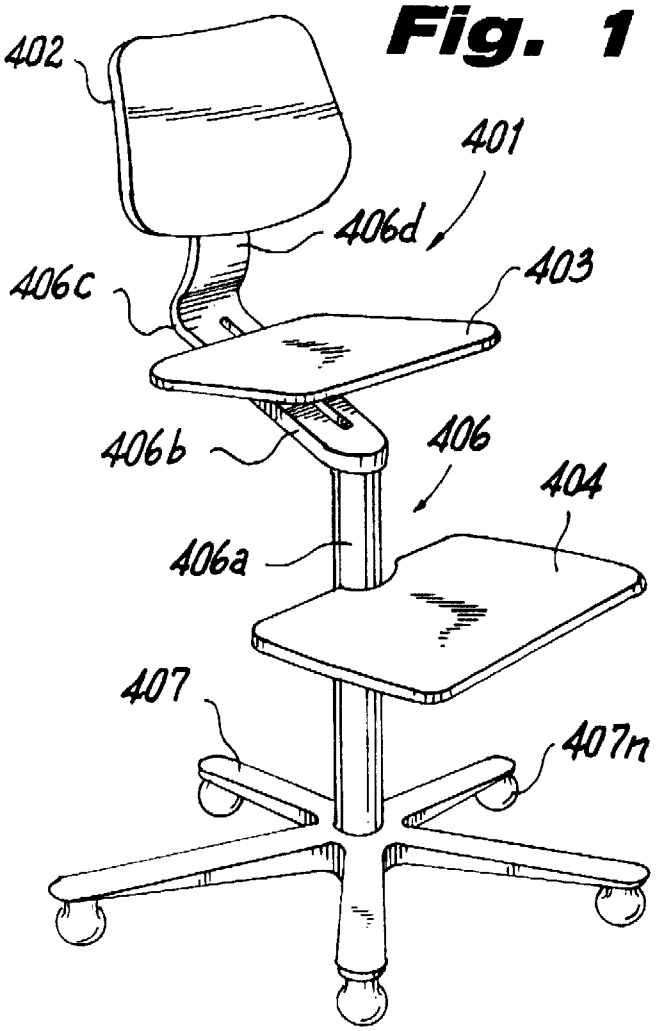

In FIGS. 11 and 12 there are illustrated perspective views as seen from the front and from the rear, respectively, of yet another embodiment of a chair 401 according to the invention, comprising a leg cross 407 having caster wheels 407*n* or sliding knobs, which makes the chair 401 easily moveable. It can here be contemplated a pivotable variant which in combination with raising and lowering of the column height increases the possibilities of regulation and application. From the leg cross 407 there extends a substantially vertical cylinder 406*a* carrying the foot support 404, and merging into a slanted portion 406*b* carrying the chair seat 403 and at its upper portion merging into a double-curved portion 406*c* which at the top comprises a portion 406*d* carrying the back rest 402, said portions 406*a*, 406*b*, 406*c*, 406*d* constituting the mid-stem 406 itself.

Figure 14:
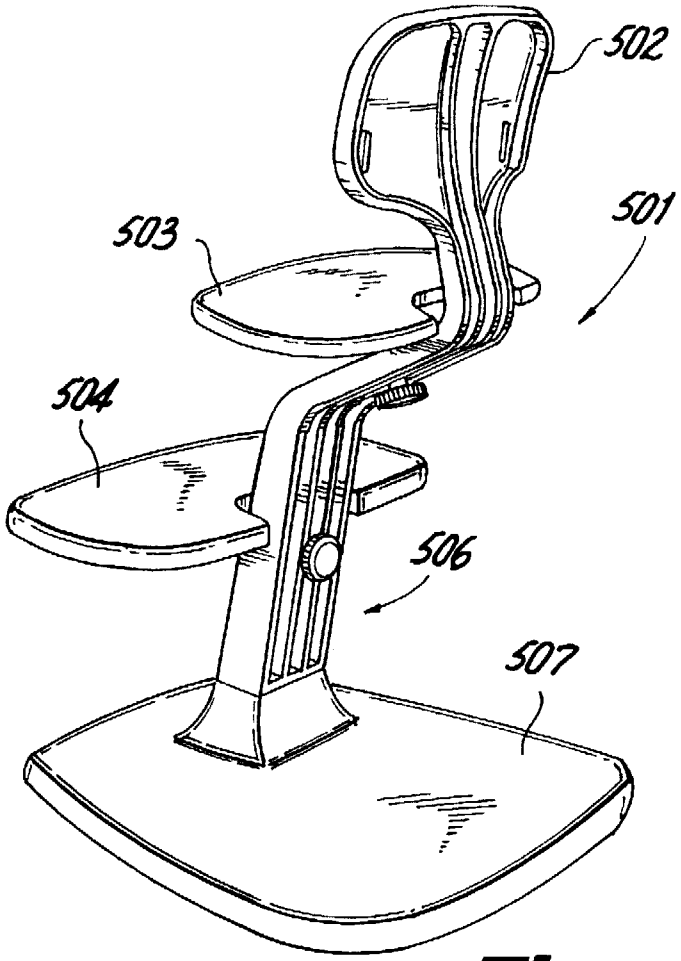
FIGS. 13 and 14 are perspective views as seen from the front the rear, respectively, of yet another embodiment of a chair according to the invention.
Figure 13:
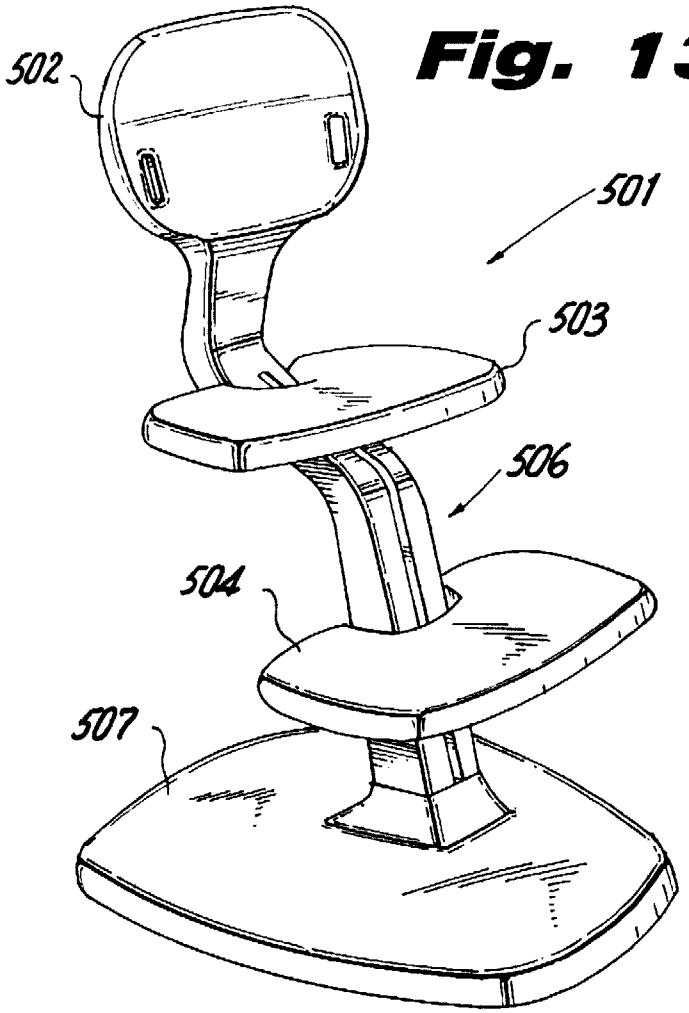

In FIGS. 13 and 14 there are illustrated perspective views as seen from the front and from the rear, respectively, of a further embodiment of a chair 501 according to the invention. Here, the base 507 is favourably provided from moulded material carrying a mid-stem 506 which can also be manufactured from moulded material co-moulded with the back rest 502, connected to or possibly co-moulded with a leg cross or base 507. The material can be provided appropriately soft or be provided with additionally moulded material for comfortable sitting, possibly having a layer or cover adapted to the various fields of application.

It is to be understood that within the scope of the present invention many further embodiments can be contemplated beyond what has been disclosed so far. The design of the upper portion of the mid-stem can of course be realised in a plurality of manners, the interchange of slanted and bent, or double-curved portions allowing for variations within wide limits.

In relation to a substantially affixed back rest it can thus in a simple manner be provided a main adjustment of the chair seat along the regulating portion of the midstem comprising regulating angles from 10°–55°, a main adjustment for example being that the elbow of the user shall be flush with the height of the table, the seat depth then automatically having a correct dimension in relation to the body size of the user, i.e. the seat depth is given by itself.

Thereafter, there can be effected a regulation of the foot support along the second portion having an angle between 65°–90°, depending upon the leg length of the user.

The regulation can be effected in a simple manner from the rear of the chair, possibly only with a single hand, and possibly whilst a child is seated on the chair seat, it being unnecessary to lift the chair seat during the regulation. The regulation can be effected specifically simple if a ratchet mechanism having small regulating steps is chosen.

Even if such a chair is positioned close to a table it will offer a simple and safe side access for stepping into the chair i.e. without having to move the chair away from the table in order to make access for the user, specifically as regards smaller children.

The combination of a mid-stem, larger foot support than chair seat and recess in the foot support will improve the staircase step facilities of the chair when stepping into the chair from the side and even when entering the chair from the rear, i.e. there is avoided a vertical ladder as well as barring chair legs, at the same time as the foot support also renders further foot support in sitting position with legs in retracted positions.

By using a recess in the chair seat the mid-column does not need to protrude a great distance rearwardly into the room, which together with the single mid-stem renders a space saving furniture having an appropriate structure and varying design.

I claim:

1. An arrangement in a chair resting on a foundation, said chair comprising in combination:

a column-like support having a mid-stem comprising a rearwardly extending upper regulating portion angled upwardly in a range of 10°–55° relative to the foundation and a rearwardly extending lower regulating portion angled upwardly in a range of 65°–90° relative to the foundation, a back rest attached to said support;

a chair seat;

a first attachment means connecting said chair seat to the upper regulating portion having means for adjusting the position of said chair seat along the upper regulating portion and thereby the level of said chair seat above the foundation of the chair;

a foot support;

a second attachment means connecting said foot support to the lower regulating portion having means for adjusting the position of said support along the lower regulating portion and thereby the level of said foot support above the foundation of the chair;

said support and said chair each having a central projection plane, the central projection plane of said support substantially coinciding with the central plane of the chair.

2. An arrangement as claimed in claim 1, wherein said mid-stem comprises a substantial portion of said support and has at least one branch in the central projection plane of said support.

3. An arrangement as claimed in claim 1, wherein the angles of said upper and lower regulating portions are substantially constant.

4. An arrangement as claimed in claim 1, wherein:

said mid-stem has a lower portion;

said foot support has a rear edge with a recess therein which at least partly embraces said lower portion of said mid-stem;

said foot support further comprising side portions which protrude rearwardly beyond said mid-stem.

5. An arrangement as claimed in claim 1, wherein said mid-stem comprises a double-bent portion above said upper regulating portion.

6. An arrangement as claimed in claim 1, wherein said foot support is larger than said chair seat.

7. An arrangement as claimed in claim 1, wherein the mid-stem comprises at least one conical portion to reduce sliding of the foot support and chair seat upon loading.

8. An arrangement as claimed in claim 1, wherein the means for adjusting said chair seat and foot support, respectively, are each constructed to be operated from the rear of the chair.

9. An arrangement as claimed in claim 1, wherein the mid-stem is substantially one continuous member.

10. An arrangement as claimed in claim 1, wherein a portion of said mid-stem above said upper regulating portion is substantially perpendicular to said upper regulating portion to form an angle having its cusp facing rearwardly from said chair.

11. An arrangement as claimed in claim 1, wherein said mid-stem comprises:

a first portion comprising the lower regulating portion;

a second portion comprising the upper regulating portion and merging into said first portion;

a third portion comprising a forwardly slanted portion of said mid-stem which merges into said second portion; and a fourth portion comprising a forwardly slanted portion of said mid-stem which is less slanted than said third portion and merges into said third portion;

said back rest being attached to said fourth portion.

12. An arrangement as claimed in claim 1, wherein said mid-stem comprises a lower protruding portion in the central plane of said chair to provide additional support for said chair.

13. An arrangement as claimed in claim 1, wherein said lower regulating portion comprises a regulating track along which the foot support can be positioned, and said upper regulating portion comprises a regulating track along which the chair seat can be positioned.

14. An arrangement as claimed in claim 1, wherein said mid-stem comprises two substantially similar stem portions having a gap therebetween; and said first attachment means and said second attachment means are positioned within said gap.

15. An arrangement as claimed in claim 1, wherein each of said first and second attachment means is constructed to be operated by hand.

16. An arrangement as claimed in claim 1, wherein the angle of at least one of said upper and lower regulating portion varies along its length.

17. An arrangement as claimed in claim 1, wherein said mid-stem comprises two or more joined sections.

18. An arrangement as claimed in claim 1, wherein a portion of said mid-stem above said upper regulating portion forms an obtuse angle relative to said upper regulating portion having its cusp facing rearwardly from said chair.

19. An arrangement as claimed in claim 1, wherein the chair seat extends forward of the back rest and has a rear edge with a recess therein which allows a portion of the chair seat to extend behind the back rest when the chair seat is positioned near the back rest, thereby reducing an effective chair seat surface on which a user may sit.

20. An arrangement as claimed in claim 19, wherein said mid-stem comprises a bent portion above said upper regulating portion, said recess providing for a reduced effective chair seat surface when said chair seat is positioned in the area of said bent portion.

21. An arrangement as claimed in claim 1, wherein said upper regulating portion protrudes freely from said mid-stem.

22. An arrangement as claimed in claim 21, wherein said upper and lower regulating portions form a substantially V-shaped portion in said mid-stem.

23. An arrangement as claimed in claim 1, wherein said mid-stem has an upper portion and said chair further comprises a guarding means removably mounted to said upper portion.

24. An arrangement as claimed in claim 23, wherein said back rest is removably mounted to said support.

25. An arrangement as claimed in claim 1, wherein said support further comprises a base.

26. An arrangement as claimed in claim 25, wherein said base further comprises rolling means and said lower regulating portion comprises a substantially vertical cylinder.

27. An arrangement as claimed in claim 25, wherein said base consists of crossed legs, a ring, or a plate.

28. An arrangement as claimed in claim 25, wherein said base comprises a plate made of moulded material.

29. An arrangement as claimed in claim 28, wherein said back rest and said mid-stem are co-molded to form a substantially unitary element.

* * * * *